US007344365B2

(12) United States Patent
Takeuchi et al.

(10) Patent No.: US 7,344,365 B2
(45) Date of Patent: Mar. 18, 2008

(54) SCROLL COMPRESSOR WITH BYPASS HOLES COMMUNICATING WITH AN INTAKE CHAMBER

(75) Inventors: Makoto Takeuchi, Aichi (JP); Tetsuzo Ukai, Aichi (JP); Masaaki Tokuda, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/602,965

(22) Filed: Nov. 22, 2006

(65) Prior Publication Data

US 2007/0065325 A1 Mar. 22, 2007

Related U.S. Application Data

(62) Division of application No. 10/914,644, filed on Aug. 10, 2004, now abandoned.

(30) Foreign Application Priority Data

Aug. 11, 2003 (JP) ..... 2003-291296
Aug. 11, 2003 (JP) ..... 2003-291297

(51) Int. Cl.
*F03C 2/00* (2006.01)
*F04C 18/00* (2006.01)
*F04C 2/00* (2006.01)

(52) U.S. Cl. ..... 418/55.2; 418/55.1; 418/55.5; 418/57

(58) Field of Classification Search ..... 418/14, 418/15, 55.1–55.6, 57
See application file for complete search history.

(56) References Cited

U.S. PATENT DOCUMENTS 5,674,058 A 10/1997 Matsuda et al.
5,855,475 A 1/1999 Fujio et al.
6,659,745 B2 12/2003 Fujita et al.

(Continued)

FOREIGN PATENT DOCUMENTS

EP 58-30494 2/1983

(Continued)

OTHER PUBLICATIONS

Chinese Office Acton issued in Corresponding Application No. 200410071339.7 dated Oct. 27, 2006.

(Continued)

*Primary Examiner*—Theresa Trieu
(74) *Attorney, Agent, or Firm*—Westerman, Hattori, Daniels & Adrian, LLP.

(57) ABSTRACT

A scroll compressor includes a first scroll and a second scroll. The first scroll has a step portion that separates an elevated portion and a recessed portion of a surface of the first scroll. A spiral wall of the second scroll has a step that separates an elevated portion and a recessed portion of the wall. A first bypass hole is provided in the elevated portion of the surface of the first scroll. A second bypass hole is provided in the recessed portion of the surface of the first scroll. The second bypass hole is within 360 degrees toward a center of the spiral of the first scroll from an outer end of the spiral. The first bypass hole is within 360 degrees from the second bypass hole toward the center of the spiral.

2 Claims, 14 Drawing Sheets

U.S. PATENT DOCUMENTS

| | | | |
|---|---|---|---|
| 6,746,224 | B2 | 6/2004 | Itoh et al. |
| 6,758,658 | B2 | 7/2004 | Fujita et al. |

FOREIGN PATENT DOCUMENTS

| | | | |
|---|---|---|---|
| EP | 58-10128 | | 6/1983 |
| EP | 2000-291573 | | 10/2000 |
| EP | 2002-5054 | | 1/2002 |
| EP | 1279835 | A2 | 1/2003 |
| JP | 60-17956 | | 5/1985 |
| JP | 1-33675 | | 7/1989 |
| JP | 05-071477 | A | 3/1993 |
| JP | 07279879 | A | 10/1995 |
| JP | 08-061269 | A | 3/1996 |
| JP | 09-217691 | A | 8/1997 |
| JP | 11-324951 | A | 11/1999 |
| JP | 2001-132667 | A | 5/2001 |
| JP | 2002-5053 | | 1/2002 |

OTHER PUBLICATIONS

Search Report dated Apr. 27, 2007, issued in corresponding European Application No. 07103104.1.

Office Action dated Oct. 30, 2007 issued in corresponding Japanese Application No. 2003-291296.

Office Action dated Oct. 30, 2007 issued in corresponding Japanese Application No. 2003-291297.

SCROLL COMPRESSOR WITH BYPASS HOLES COMMUNICATING WITH AN INTAKE CHAMBER

This application is a divisional of application Ser. No. 10/914,644, filed Aug. 10, 2004 now abandoned.

BACKGROUND OF THE INVENTION

1) Field of the Invention

The present invention relates to a scroll compressor in an air conditioning apparatus, a refrigerating apparatus, and the like.

2) Description of the Related Art

A scroll compressor includes a fixed scroll and a revolving scroll. The fixed scroll includes a spiral wall that is vertically fixed to an end plate. The revolving scroll also includes a spiral wall, which has substantially the same shape as the wall of the fixed scroll, that is vertically fixed to another end plate. The scroll compressor is assembled in such a manner that the walls of the fixed scroll and the revolving scroll engage with each other. In this state, the revolving scroll is revolved with respect to the fixed scroll, whereby a volume of a compression chamber formed between the walls is gradually reduced to compress fluid in the compression chamber.

Some conventional scroll compressors are provided with a step portion between the spiral walls. The step portion is formed with surfaces at different levels. The surface that is closer to an inner end of the spiral (closer to a center of the spiral) is more distant from a surface of the end plate than the surface that is closer to an outer end of the spiral (closer to a fluid drawing port). An edge of the wall is formed in a shape engaging with a corresponding step portion. With such a structure, a fluid drawing capacity of a chamber on the outer end side of the spiral is increased, and pressure in a chamber on the inner end side is increased. Thus, an improved compression ratio is obtained without increasing an outer diameter of a scroll (e.g., Japanese Patent Publication No. S60-17956).

In other conventional scroll compressors, a fluid through hole (bypass hole) is provided in an end plate in a portion between a spiral wall of a fixed scroll. The fluid through hole is openable and closable. With this structure, by opening the fluid through hole as required, a compression volume in a compression chamber is reduced to lower a load on a drive source (e.g., Japanese Patent Publication No. H1-33675).

However, when the bypass hole is provided in a portion that is closer to the outer end of the spiral than the step portion, there is a problem in that a compression loss occurs due to leakage of fluid from an engaging part of the step portion and the wall. On the other hand, when the bypass hole is provided in a portion that is closer to the center of the spiral than the step portion, since compression is performed on the outer end side of the spiral, there is a problem in that excessive compression occurs before reducing a compression volume with the bypass hole. A load is applied to a drive source in an area where the excessive compression occurs.

SUMMARY OF THE INVENTION

It is an object of the present invention to provide a scroll compressor that makes it possible to reduce the compression loss.

A scroll compressor according to an aspect of the present invention includes a first scroll that includes a first plate having a surface and a first wall fixed in a spiral manner on the surface of the first plate; a second scroll that includes a second plate having a surface and a second wall fixed in a spiral manner on the surface of the second plate, wherein the first wall of the first scroll and the second wall of the second scroll engage with each other thereby forming a plurality of compression chambers, and the first scroll and the second scroll rotate relative to each other; the surface of the first plate having a first bottom portion and a second bottom portion and the first bottom portion and the second bottom portion are separated by a first bottom step, wherein the first bottom portion is positioned inside a first spiral formed by the first wall and near a center of the first spiral, the first bottom portion is elevated in a direction of height of the first wall, the second bottom portion is positioned inside the first spiral and on an outer end of the first spiral, and the second bottom portion is recessed in the direction of the height of the first wall; the second wall of the second scroll having a first wall portion and a second wall portion and the first wall portion and the second wall portion are separated by a first wall step, wherein the first wall portion is positioned on a free end of the second wall and near a center of a second spiral formed by the second wall, the first wall portion is recessed in a direction of height of the second wall, the second wall portion is positioned on the free end of the second wall and on an outer end of the second spiral, and the second wall portion is elevated in the direction of the height of the second wall, and at one particular point the first bottom step abutting with the first wall step when the first scroll and the second scroll rotate relative to each other; and a bypass hole in the first bottom portion and that lets a compression chamber among the compression chambers to communicate with outside.

The other objects, features, and advantages of the present invention are specifically set forth in or will become apparent from the following detailed description of the invention when read in conjunction with the accompanying drawings.

DETAILED DESCRIPTION

Exemplary embodiments of a scroll compressor according to the present invention will be hereinafter explained with reference to the accompanying drawings.

Figure 1:
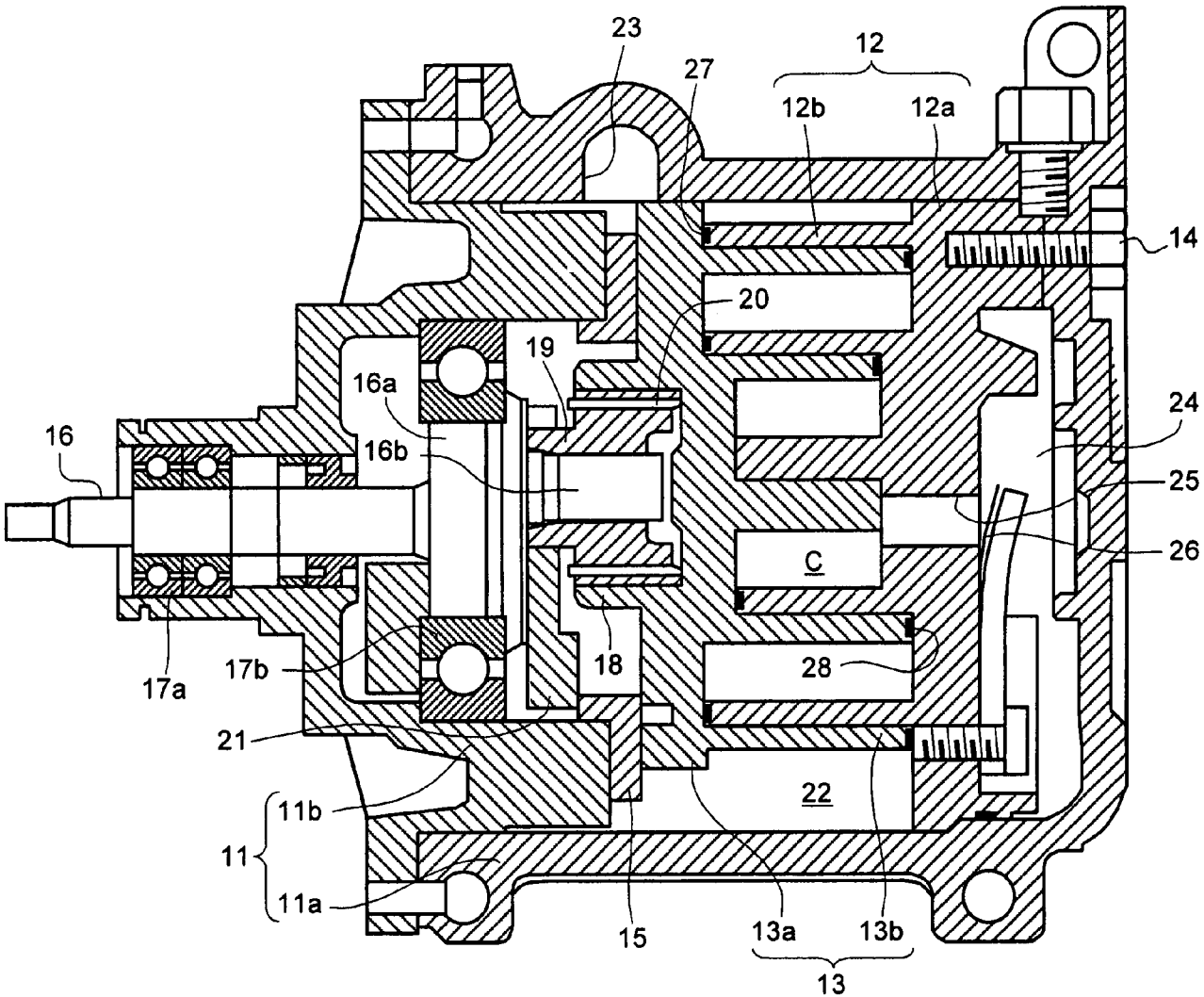
FIG. 1 is a sectional view of a scroll compressor in a first embodiment according to the present invention.

FIG. 1 is a sectional view of a scroll compressor according to a first embodiment of the present invention. This scroll compressor is provided with a scroll compression mechanism that includes a fixed scroll 12 that serves as a first scroll, and a revolving scroll 13 that serves as a second scroll. The fixed scroll 12 and the revolving scroll 13 are housed in a housing 11.

The housing 11 includes a housing body 11*a* that is formed in a cup shape, which has an opening, and a lid plate 11*b* that is fixed to the housing body 11*a* at the opening.

The fixed scroll 12 includes a spiral wall 12*b* on a surface of an end plate 12*a*. The spiral wall 12*a* is arranged vertically to the end plate 12*a*. The revolving scroll 13 has substantially a same structure as the fixed scroll 12, and includes a spiral wall 13*b* on a surface of an end plate 13*a*. The spiral wall 13*a* is arranged vertically to the end plate 13*a*. The wall 12*b* and the wall 13*b* are formed in substantially an identical shape.

The fixed scroll 12 is fastened to a bottom inside the cup shape of the housing body 11*a* with a bolt 14. The revolving scroll 13 is eccentric by a revolution radius and phase-shifted by 180 degrees with respect to the fixed scroll 12, and is combined with the fixed scroll 12 with the wall 13*b* thereof engaged with the wall 12*b* of the fixed scroll 12. Further, the revolving scroll 13 is supported to be capable of revolving, but not to be capable of rotating. A rotation preventing mechanism 15 that is provided between the lid plate 11*b* and the end plate 13*a* prevents the revolving scroll 13 from rotating.

Concerning the revolution of the revolving scroll 13, a rotation shaft 16 with a crank 16*a* is pierced through the lid plate 11*b*. This rotation shaft 16 is rotatably supported on the lid plate 11*b* via bearings 17*a* and 17*b*. A boss 18 is protrudingly provided in the center of the end plate 13*a* on a surface that is on an opposite side to the surface on which the wall 13*b* is arranged. An eccentric portion 16*b* of the crank 16*a* is rotatably housed in the boss 18 via a bearing 19 and a drive bush 20. Consequently, the revolving scroll 13 revolves according to the rotation of the rotation shaft 16. A balance weight 21, which cancels an unbalance amount given to the revolving scroll 13, is attached to the rotation shaft 16.

An intake chamber 22 is formed in a position around the fixed scroll 12 inside the housing body 11*a*. With respect to this intake chamber 22, an intake port 23, which guides low-pressure fluid toward the intake chamber 22, is provided in the housing body 11*a*. A discharge cavity 24 is arranged inside the housing body 11*a*. The discharge cavity 24 is sectioned by an inner surface at the bottom of the cup-shaped body of the housing body 11*a* and a surface of the end plate 12*a* that is on the opposite side to the surface on which the wall 12 *b* is arranged. With respect to this discharge cavity 24, a discharge port 25, which guides high-pressure fluid toward the discharge cavity 24, is arranged at the center of the end plate 12*a* on the surface on which the fixed scroll 12 is arranged. This discharge port 25 is provided in communication with a compression chamber C, which moves to the center of the spirals of the walls 12*b* and 13*b* while gradually reducing a volume thereof, in the scroll compression mechanism consisting of the fixed scroll 12 and the revolving scroll 13. A discharge valve 26, which opens the discharge port 25 only when a predetermined or higher pressure acts thereon, is provided in the center of the end plate 12*a* on the surface that sections the discharge cavity 24.

Figure 2:
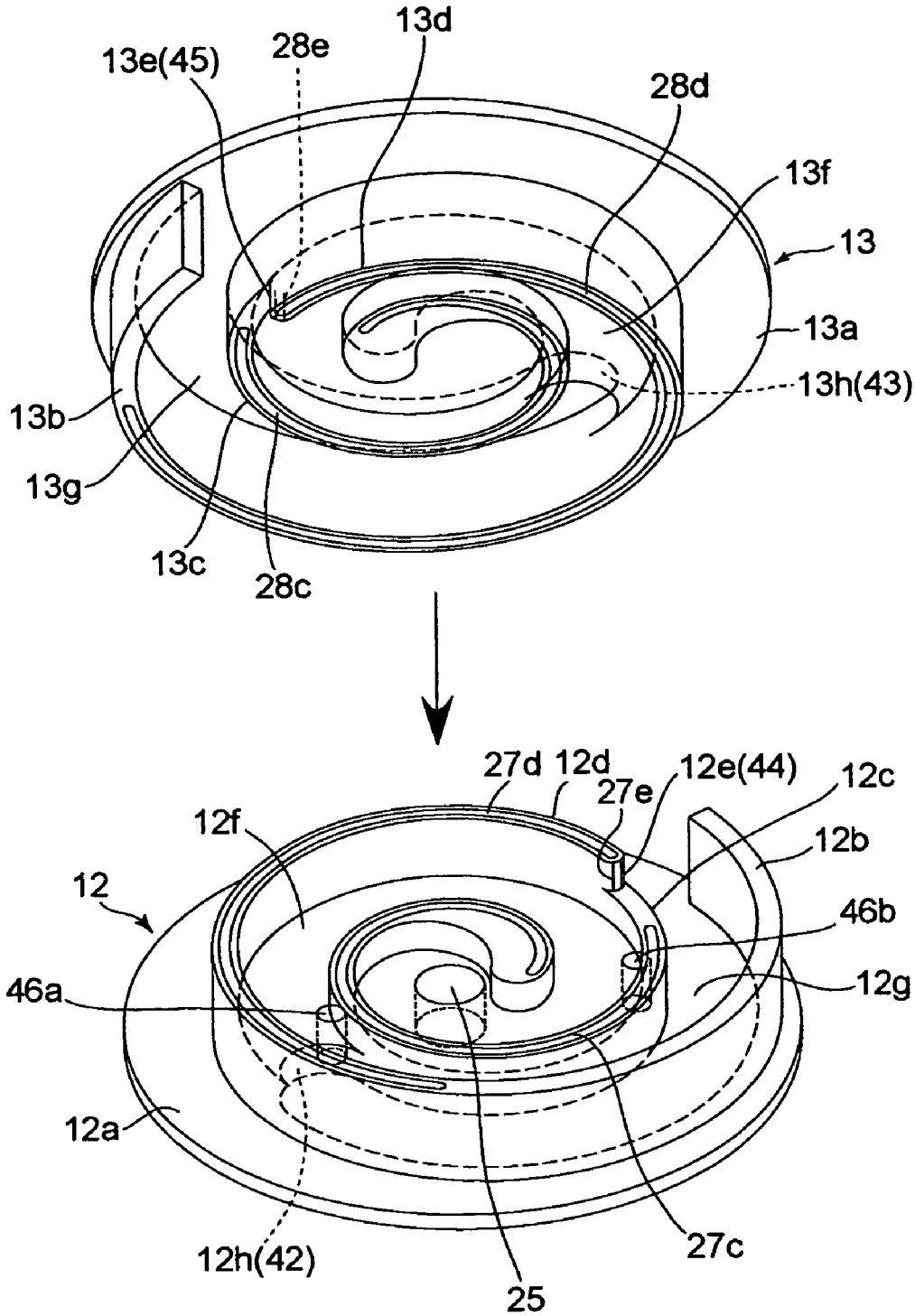
FIG. 2 is a perspective view of a fixed scroll and a revolving scroll in the first embodiment.

As shown in FIG. 2, the end plate 12*a* of the fixed scroll 12 includes a step portion 42. At this step portion 42, the surface of the end plate 12*a* that is toward the center of the spiral, which is formed by the wall 12*b*, is elevated than the surface of the end plate 12*a* that is toward the outer end of the spiral. Similarly, the end plate 13*a* of the revolving scroll 13 includes a step portion 43. At this step portion 43, the surface of the end plate 13*a* that is toward the center of the spiral, which is formed by the wall 13*b*, is elevated than the surface of the end plate 13*a* that is toward the outer end of the spiral. The step portions 42 and 43 are provided at positions that are substantially equidistance from the centers of the respective spirals.

Since the step portion 42 is formed on the surface of the end plate 12*a*, the flow path formed in the wall 12*b* can be divided into two portions, that is, a flow path having a shallower bottom surface 12*f*, which is closer to the center of the spiral, and a flow path having a deeper bottom surface 12*g*, which is closer to the outer end of the spiral. A coupling wall surface 12*h*, which is formed in the step portion 42 and stands vertically to the bottom surfaces 12*f* and 12*g*, is present between the adjacent bottom surfaces 12*f* and 12*g*. Similarly, since the step portion 43 is formed on the surface of the end plate 13*a*, a spiral flow path formed in the wall 13*b* is divided into two portions, that is, a shallow bottom surface 13*f* provided closer to the center and a deep bottom surface 13*g* provided closer to the outer end. A coupling wall surface 13*h*, which forms the step portion 43 and stands vertically connecting the bottom surfaces 13*f* ad 13*g*, is present between the adjacent bottom surfaces 13*f* and 13*g*.

In addition, the wall 12*b* of the fixed scroll 12 includes a stepped portion 44 that corresponds to the step portion 43 of the revolving scroll 13. The wall 12*b* includes two portions of which edge is arranged at each different level. The edge of the portion that is closer to the center of the spiral is at a lower level than the edge of the portion that is closer to the outer end of the spiral relative to the level of the surface of the end plate 12*a*. Similarly, the wall 13*b* of the revolving scroll 13 includes a stepped portion 45 that corresponds to the step portion 42 of the fixed scroll 12. The wall 13*b* includes two portions of which edge is arranged at each different level. The edge of the portion that is closer to the center of the spiral is at a lower level than the edge of the portion that is closer to the outer end of the spiral relative to the level of the surface of the end plate 13*a*.

Since the stepped portion 44 is formed, the edge of the wall 12*b* is divided into two portions, that is, a low edge 12*c* provided closer to the center and a high edge 12*d* provided closer to the outer end. A coupling edge 12*e*, which forms the stepped portion 44 and connects the edges 12*c* and 12*d* to be vertical to a revolving surface, is present between the adjacent edges 12*c* and 12*d*. Similarly, since the stepped portion 45 is formed, the edge of the wall 13*b* is divided into two portions, that is, a low edge 13*c* provided closer to the center and a high edge 13*d* provided closer to the outer end. A coupling edge 13*e*, which forms the stepped portion 45 and connects the edges 13*c* and 13*d* to be vertical to the revolving surface, is present between the adjacent edges 13*c* and 13*d*.

The coupling edge 12*e* is formed in such a manner that a surface of the coupling edge 12*e* that is vertical to the end plate 12*a* continues smoothly curving between the wall 12*b*. A curved line formed with the surface is semicircle when viewed from a direction perpendicular to the end plate 12*a*. A diameter of the semicircle equals to a thickness of the wall 12*b*. Similarly, the coupling edge 13*e* is formed in such a manner that a surface of the coupling edge 13*e* that is vertical to the end plate 13*a* continues smoothly curving between the wall 13*b*. A curved line formed with the surface is semicircle when viewed from a direction perpendicular to the end plate 13*a*. In addition, the coupling wall surface 12*h* forms an arc that is identical with an envelope drawn by the coupling edge 13*e* in accordance with revolution of the revolving scroll 13 when the end plate 12*a* is viewed from a revolving shaft direction. Similarly, the coupling wall surface 13*h* forms an arc that is identical with an envelope drawn by the coupling edge 12*e* in accordance with revolution of the revolving scroll 13.

Figure 3:
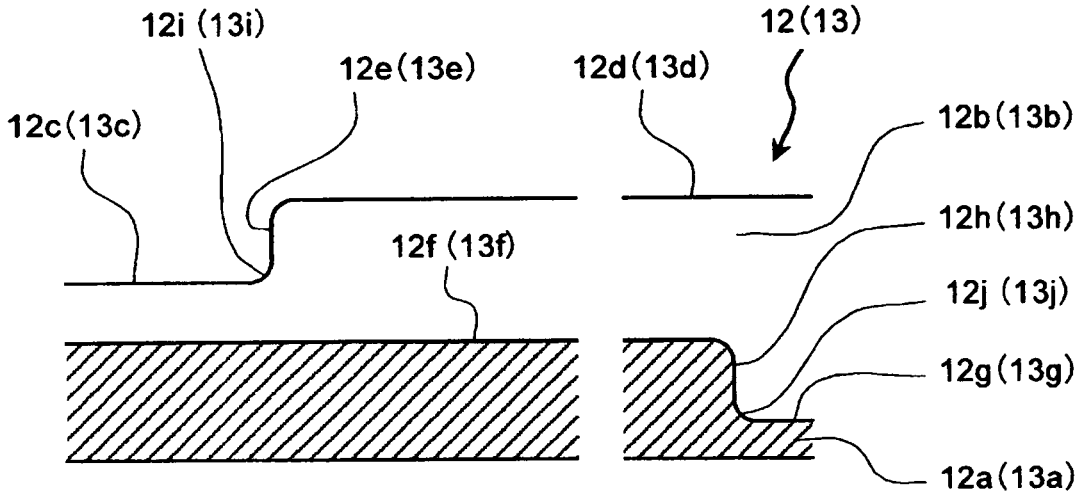
FIG. 3 is a sectional view of the fixed scroll (or the revolving scroll) in the first embodiment.

As shown in FIG. 3, a rib 12*i* is provided in a part where the edge 12*c* and the coupling edge 12*e* meet in the wall 12*b* as if the rib 12*i* is built up. The rib 12*i* is formed integrally with the wall 12*b* forming a recessed curved surface that continues smoothly to the edge 12*d* and the coupling edge 12*e* to avoid concentration of stresses. For the same reason, a rib 13*i* that has a same shape as the rib 12*i* is provided in a part where the edge 13*c* and the coupling edge 13*e* meet in the wall 13*b*.

A rib 12*j* is provided in a part where the bottom surface 12*g* and the coupling wall surface 12*h* meet in the end plate 12*a* as if the rib 12*j* is built up. The rib 12*j* is formed integrally with the wall 12*b* forming a recessed curved surface that continues smoothly to the bottom surface 12*g* and the coupling wall surface 12*h* to avoid concentration of stresses. Due to the same reason, a rib 13*j* of the same shape is provided in a part where the bottom surface 13*g* and the coupling wall surface 13*h* meet in the end plate 13*a*.

A part where the edges 12*d* and 12*e* meet in the wall 12*b* is chamfered to avoid interference with the rib 13*j* at the time of assembling. A part where the edges 13*d* and 13*e* meet in the wall 13*b* is chamfered to avoid interference with the rib 12*j* at the time of assembling.

As shown in FIG. 2, chip seals 27*c*, 27*d*, and 27*e* are disposed in the edges 12*c* and 12*d* and the coupling edge 12*e* of the wall 12*b*, respectively. Similarly, chip seals 28*c*, 28*d*, and 28*e* are disposed in the edges 13*c* and 13*d* and the coupling edge 13*e* of the wall 13, respectively.

Figure 4:
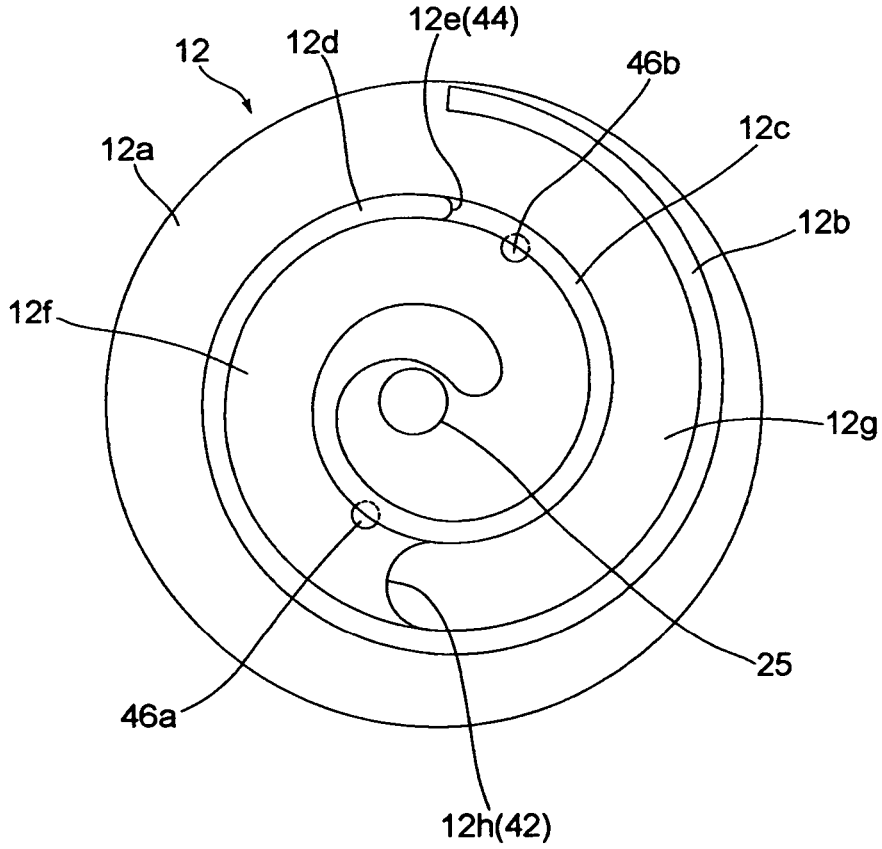
FIG. 4 is a plan view of the fixed scroll in the first embodiment.

On the other hand, as shown in FIGS. 2 and 4, bypass holes 46*a* and 46*b* that pair off with each other are provided on a bottom surface 12*f*. The bottom surface 12*f* is a surface of a portion in the end plate 12*a* of the fixed scroll 12 that is positioned closer to the center of the spiral than the position of the step portion 42. The bypass hole 46*a* is arranged on the bottom surface 12*f* at a position near the outer end of the spiral, and is arranged along the surface of the wall 12*b* that faces opposite to the center of the spiral. The bypass hole 46*b* is in a symmetrical position with respect to the bypass hole 46*a* and is arranged on the bottom surface 12*f* in a position near the center of the spiral, and is arranged along the surface of the wall 12*b* that faces toward the center of the spiral.

In a state in which the revolving scroll 13 is combined with the fixed scroll 12, openings of the bypass holes 46*a* and 46*b* facing the end plate 12*a* are made openable and closable by the low edge 13*c* of the wall 13*b* of the revolving scroll 13. In addition, the bypass holes 46*a* and 46*b* are pierced through the end plate 12*a* and open at the surface opposite to the surface on which the wall 12*b* is arranged. Although not clearly shown in the figures, opening of the bypass holes 46*a* and 46*b* communicate with the intake chamber 22. For example, a part of the housing body 11*a*, where the opening of the bypass holes 46*a* and 46*b* are located, is divided from the discharge cavity 24 by a partition wall or the like and communicates with the intake chamber 22. In addition, although not clearly shown in the figures, valves are provided at the opening of the bypass holes 46*a* and 46*b*. The valves open and close the opening as required.

Figure 5:
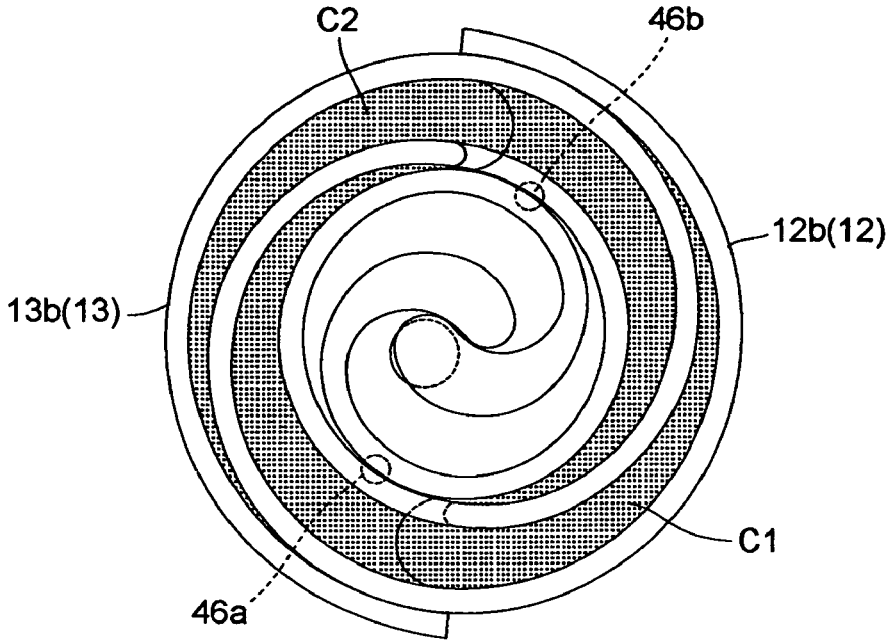
FIGS. 5 to 9 are schematics for explaining an operation of the scroll compressor of the first embodiment.

As shown in FIG. 5, when the revolving scroll 13 is combined with the fixed scroll 12, the low edge 13*d* comes into abutment against the shallow bottom surface 12*f*, and the high edge 13*c* comes into abutment against the deep bottom surface 12*g*. At the same time, the low edge 12*d* comes into abutment against the shallow bottom surface 13*f*, and the high edge 12*c* comes into abutment against the deep bottom surface 13*g*. Consequently, a pair of compression chambers C1 and C2, which are sectioned by the end plates 12*a* and 13*a* and the walls 12*b* and 13*b* opposed to each other, respectively, are formed between both the scrolls. In these compression chambers C1 and C2, since the deep bottom surfaces 12*g* and 13*g* face each other on the side closer to the outer end of the spiral than the step portions 42 and 43, the wide compression chambers C1 and C2 are obtained on the side. Since the shallow bottom surfaces 12*f* and 13*f* face each other on side closer to the center of the spiral than the step portions 42 and 43, the narrow compression chambers C1 and C2 are obtained on the side closer to the center of the spiral than the step portions 42 and 43. As a result, compression with a volume gradually reduced from the compression chambers C1 and C2 formed wide to the compression chambers C1 and C2 formed narrow is performed in the middle of movement of the compression chambers C1 and C2 from the outer end to the center in accordance with revolution of the revolving scroll 13. Thus, a compression ratio can be improved.

In the middle of movement of the compression chambers C1 and C2 from the outer end to the center in accordance with the revolution of the revolving scroll 13, when the edge 13*c* of the wall 13*b* comes off the opening of each of the bypass holes 46*a* and 46*b* facing toward the end plate 13*a*, and the valve at the opening of each of the bypass holes 46*a* and 46*b* that opens at the other side of the end plate 12*a* is opened, the bypass holes 46*a* and 46*b* cause the compression chambers C1 and C2 and the intake chamber 22 to communicate with each other. In addition, the bypass holes 46*a* and 46*b* separate the compression chambers C1 and C2 and the intake chamber 22 when the valve is closed. As a result, if the valves are opened as required, since compression is not performed in the compression chambers C1 and C2 of which compression is released through the opening of the bypass holes 46*a* and 46*b*, it becomes possible to reduce a compression volume to reduce load on the drive source driving the rotation shaft 16. In this way, the bypass holes 46*a* and 46*b* performs volume control for the compression chambers C1 and C2.

How the scroll compressor the compresses a fluid will be explained with reference to FIGS. 5 to 9. Note that, in the following explanation, the valves are performing an opening operation in the opening of the bypass holes 46*a* and 46*b*.

In the state shown in FIG. 5, the outer end of the wall 12*b* comes into abutment against the surface of the wall 13*b* that faces opposite to the center of the spiral, and the outer end of the wall 13*b* comes into abutment against the surface of the wall 12*b* that face opposite to the center of the spiral. Fluid is encapsulated between the end plates 12*a* and 13*a* and between the walls 12*b* and 13*b*. The compression chambers C1 and C2 with a maximum volume are formed in positions opposed to each other across the center of the scroll compression mechanism. At this point, the bypass holes 46*a* and 46*b* do not communicate with the compression chambers C1 and C2.

Figure 6:
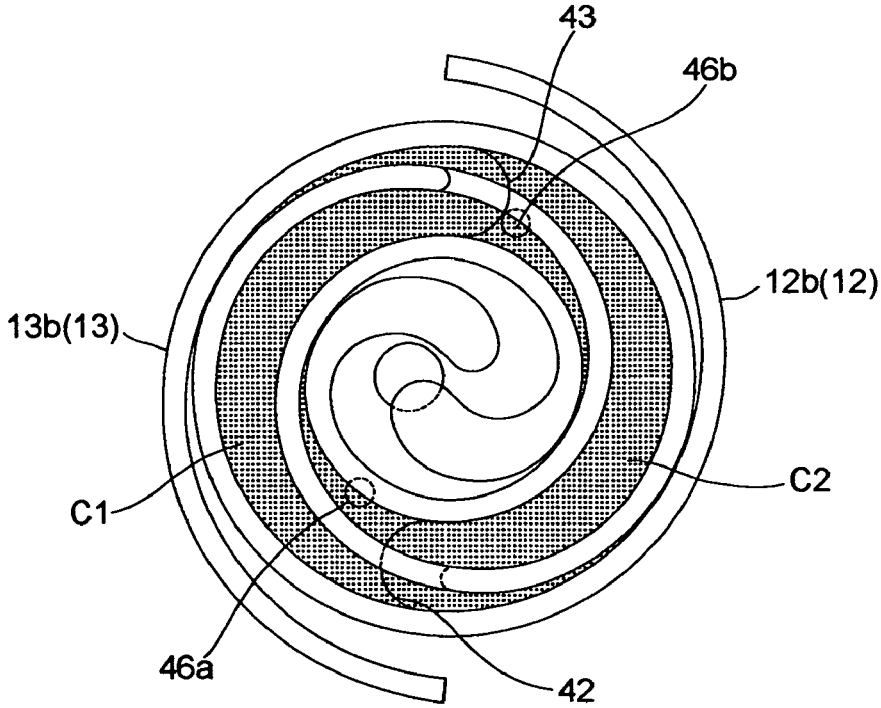

In a step in which the revolving scroll 13 revolves π/2(rad) from the state of FIG. 5 to reach a state shown in FIG. 6, the compression chambers C1 and C2 move to the center. In the state shown in FIG. 6, the bypass holes 46*a* and 46*b* communicate with the compression chambers C1 and C2. Consequently, although volumes of the compression chambers C1 and C2 are gradually reduced, compression is not performed.

Figure 7:
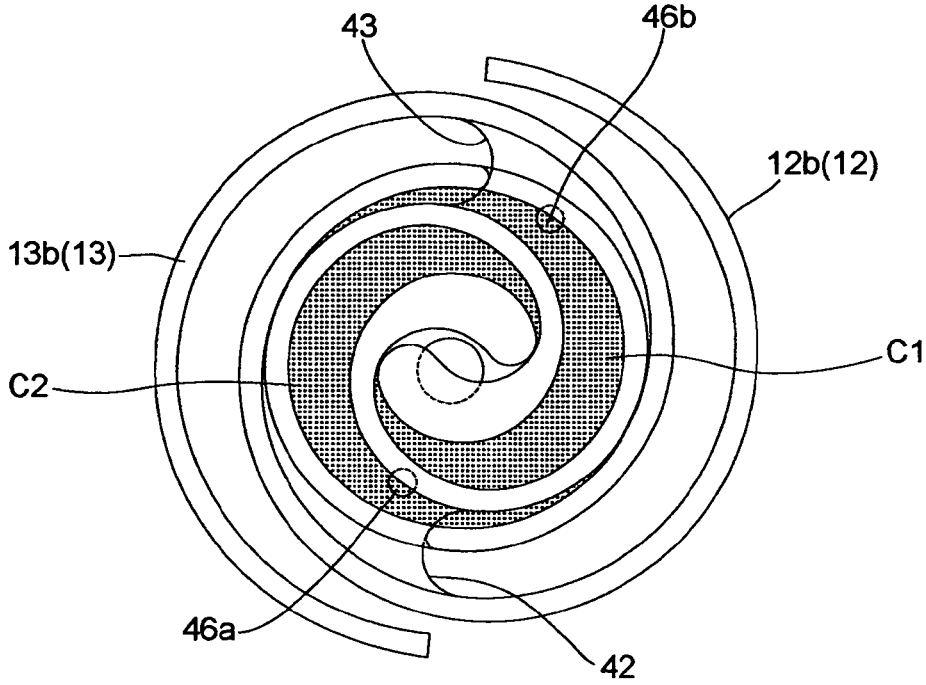

In a step in which the revolving scroll 13 revolves π(rad) from the state of FIG. 6 to reach a state shown in FIG. 7, the compression chambers C1 and C2 move to the center. In this step, since the bypass holes 46*a* and 46*b* do not communicate with the compression chambers C1 and C2, although a volume of the compression chambers C1 and C2 are gradually reduced, compression is not performed. In addition, in the state shown in FIG. 7, a portion in the outer end of the wall 12*b* is spaced apart from the surface of the wall 13*b* that faces opposite to the center of the spiral, and a portion in the outer end of the wall 13*b* is spaced apart from the surface of the wall 12*b* that faces opposite to the center of the spiral. In this case, leakage of fluid from the step portions 42 and 43 is assumed. However, since the bypass holes 46*a* and 46*b* communicate with the compression chambers C1 and C2 as described above, compression is not performed in the compression chambers C1 and C2. Thus, there is no influence of the leakage of fluid.

Figure 8:
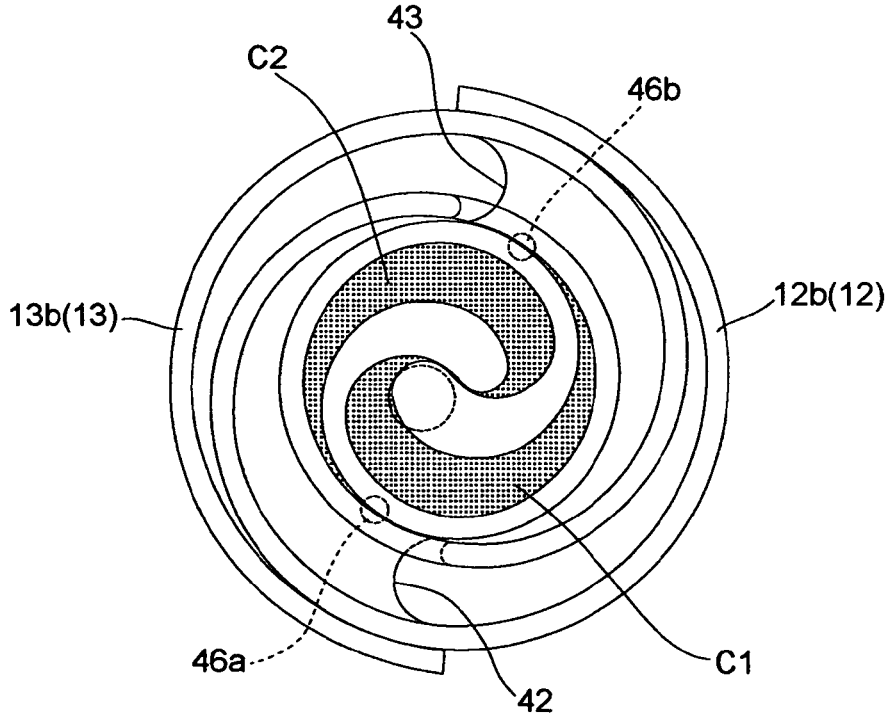

In a step in which the revolving scroll 13 revolves π/2(rad) from the state of FIG. 7 to reach a state shown in FIG. 8, the compression chambers C1 and C2 move to the center. In this step, since the bypass holes 46*a* and 46*b* communicate with the compression chambers C1 and C2, although a volume of the compression chambers C1 and C2 are gradually reduced, compression is not performed. In the state shown in FIG. 8, the opening of the bypass holes 46*a* and 46*b* are blocked by the edge 13*c* of the wall 13*b*. Consequently, the compression chambers C1 and C2 are brought into a closed state.

Figure 9:
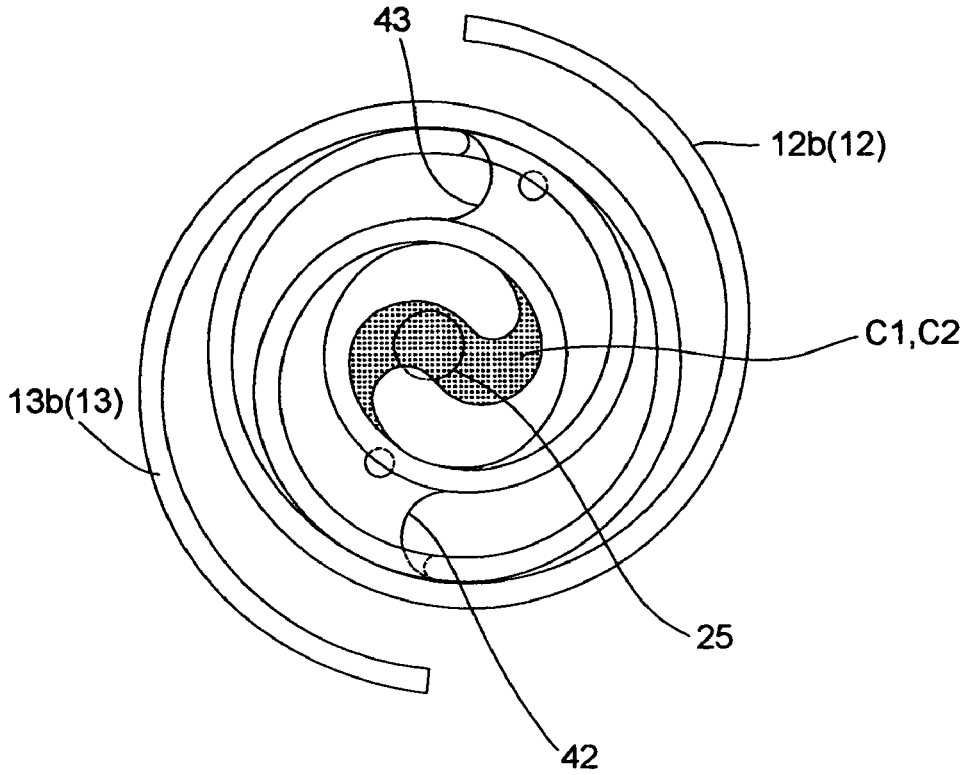

In a step in which the revolving scroll 13 revolves π(rad) from the state of FIG. 8 to reach a state shown in FIG. 9, the compression chambers C1 and C2 move to the center while keeping the closed state and a volume of the compression chambers C1 and C2 are gradually reduced to compress fluid. Thereafter, by continuing the compression, the compression chambers C1 and C2 merge to have a minimum volume, and fluid is discharged from the scroll compressor via the discharge port 25. Note that, in steps after FIG. 8, since the compression chambers C1 and C2 are in positions not involved in the step portions 42 and 43, the fluid in the compression chambers C1 and C2 never leak from the step portions 42 and 43.

Therefore, the scroll compressor according to the first embodiment includes the structure in which the step portions 42 and 43 and the bypass holes 46*a* and 46*b* are provided, and the bypass holes 46*a* and 46*b* are provided in the positions that is closer to the center of the spiral than the positions of the step portions 42 and 43. Consequently, when leakage of the fluid is assumed from a contact part of the step portions 42 and 43 and the stepped portions 44 and 45, since the bypass holes 46*a* and 46*b* communicate with the compression chambers C1 and C2 and compression is not performed, there is no influence of the leakage of the fluid. In addition, when the opening of the bypass holes 46*a* and 46*b* are blocked to bring the compression chambers C1 and C2 into the closed state, since the compression chambers C1 and C2 are in positions not involved in the step portions 42 and 43, the fluid in the compression chambers C1 and C2 never leaks from the step portions 42 and 43, and compression can be performed.

Figure 10:
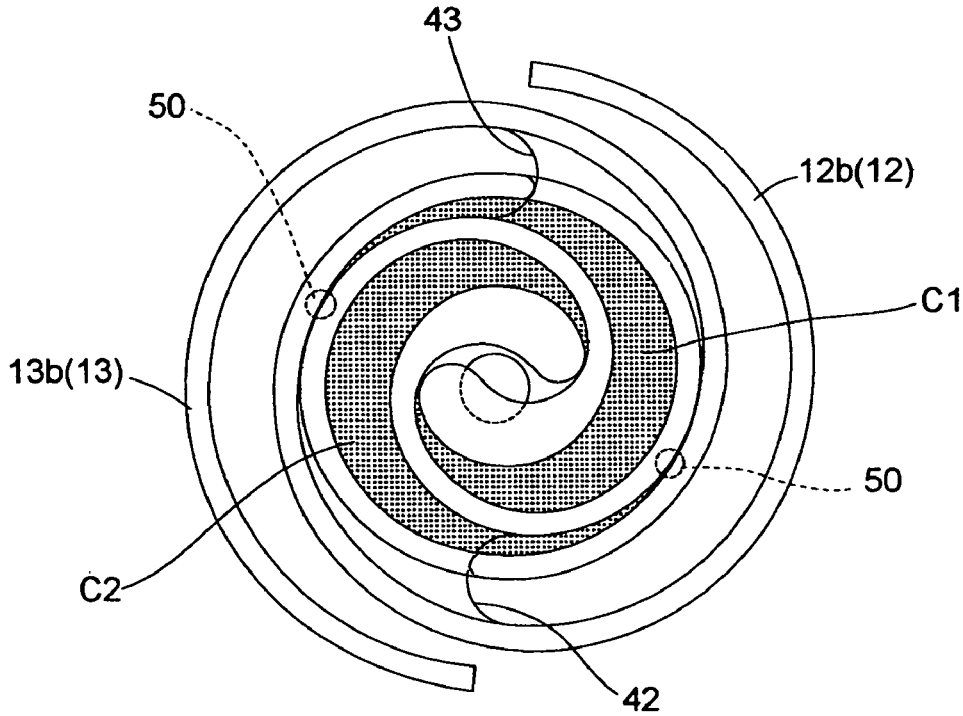
FIG. 10 is a plan view of a conventional scroll compressor corresponding to the scroll compressor of the first embodiment.

When bypass holes 50 are provided further on the outer end side of the spiral than the step portions 42 and 43 as shown in FIG. 10, even if opening of the bypass holes 50 are blocked and in a state of compression, a state occurs in which the step portions 42 and 43 are placed astride the compression chambers C1 and C2 that should perform compression. As a result, when volume control is performed in the bypass holes 50, a compression loss occurs because there is compression leakage in the step portions 42 and 43. On the other hand, the scroll compressor in the first embodiment can obtain the advantages of the step portions 42 and 43 and the bypass holes 46*a* and 46*b* without causing the compression loss.

Figure 11:
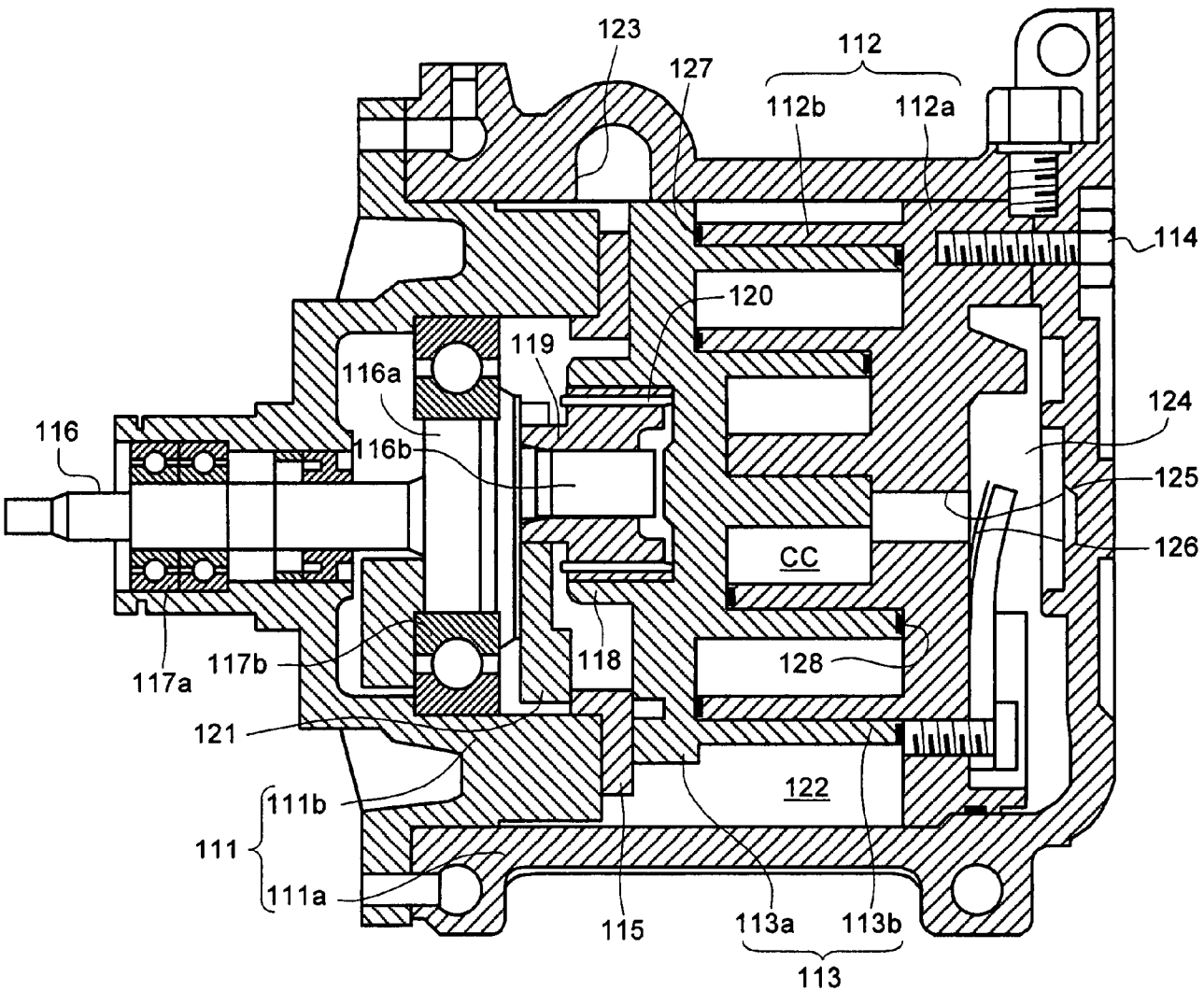
FIG. 11 is a sectional view of a scroll compressor in a second embodiment according to the present invention.

FIG. 11 is a sectional view of a scroll compressor in a second embodiment according to the present invention. This scroll compressor is provided with a scroll compression mechanism consisting of a fixed scroll 112 serving as a first scroll and a revolving scroll 113 serving as a second scroll in the inside of a housing 111.

The housing 111 includes a housing body 111*a* that is formed in a cup shape, which has an opening, and a lid plate 111*b* that is fixed to the housing body 111*a* at the opening.

The fixed scroll 112 includes vertically provided with a spiral wall 112*b* on a surface of an end plate 112*a*. The spiral wall 12*a* is arranged vertically to the end plate 112*a*. The revolving scroll 113 has substantially a same structure as the fixed scroll 112, and includes a spiral wall 113*b* on a surface of an end plate 113*a*. The wall 112*b* and the wall 113*b* are formed in substantially an identical shape.

The fixed scroll 112 is fastened to a bottom inside the cup shape of the housing body 111*a* with a bolt 114. The revolving scroll 113 is eccentric by a revolution radius and phase-shifted by 180 degrees with respect to the fixed scroll 112, and is combined with the fixed scroll 112 with the wall 113*b* thereof engaged with the wall 112*b* of the fixed scroll 112. Further, the revolving scroll 113 is supported to be capable of revolving, but not to be capable of rotating. A rotation preventing mechanism 115 that is provided between the lid plate 111*b* and the end plate 113*a* prevents the revolving scroll 113 from rotating.

Concerning the revolution of the revolving scroll 113, a rotation shaft 116 with a crank 116*a* is pierced through the lid plate 111*b*. This rotation shaft 116 is rotatably supported on the lid plate 111*b* via bearings 117*a* and 117*b*. A boss 118 is protrudingly provided in the center of the end plate 113*a* on a surface that is on an opposite side to the surface on which the wall 113*b* is arranged. An eccentric portion 116*b* of the crank 116*a* is rotatably housed in the boss 118 via a bearing 119 and a drive bush 120. Consequently, the revolving scroll 113 revolves according to the rotation of the rotation shaft 116. A balance weight 121, which cancels an unbalance amount given to the revolving scroll 113, is attached to the rotation shaft 116.

An intake chamber 122 is formed in a position around the fixed scroll 112 inside the housing body 111*a*. With respect to this intake chamber 122, an intake port 123, which guides low-pressure fluid toward the intake chamber 122, is provided in the housing body 111*a*. A discharge cavity 124 is arranged inside the housing body 111*a*. The discharge cavity 124 is sectioned by an inner surface of the housing body 111*a* and a surface of the end plate 112*a* that is on the opposite side to the surface on which the wall 112 *b* is arranged. With respect to this discharge cavity 124, a discharge port 125, which guides high-pressure fluid toward the discharge cavity 124, is arrange at the center of the end plate 112*a* on the surface on which the fixed scroll 112 is arranged. This discharge port 125 is provided in communication with a compression chamber CC, which moves to the center of the spirals of the walls 112*b* and 113*b* while gradually reducing a volume thereof, in the scroll compression mechanism consisting of the fixed scroll 112 and the revolving scroll 113. A discharge valve 126, which opens the discharge port 125 only when a predetermined or higher pressure acts thereon, is provided in the center of the end plate 12*a* on the surface that sections the discharge cavity 124.

Figure 12:
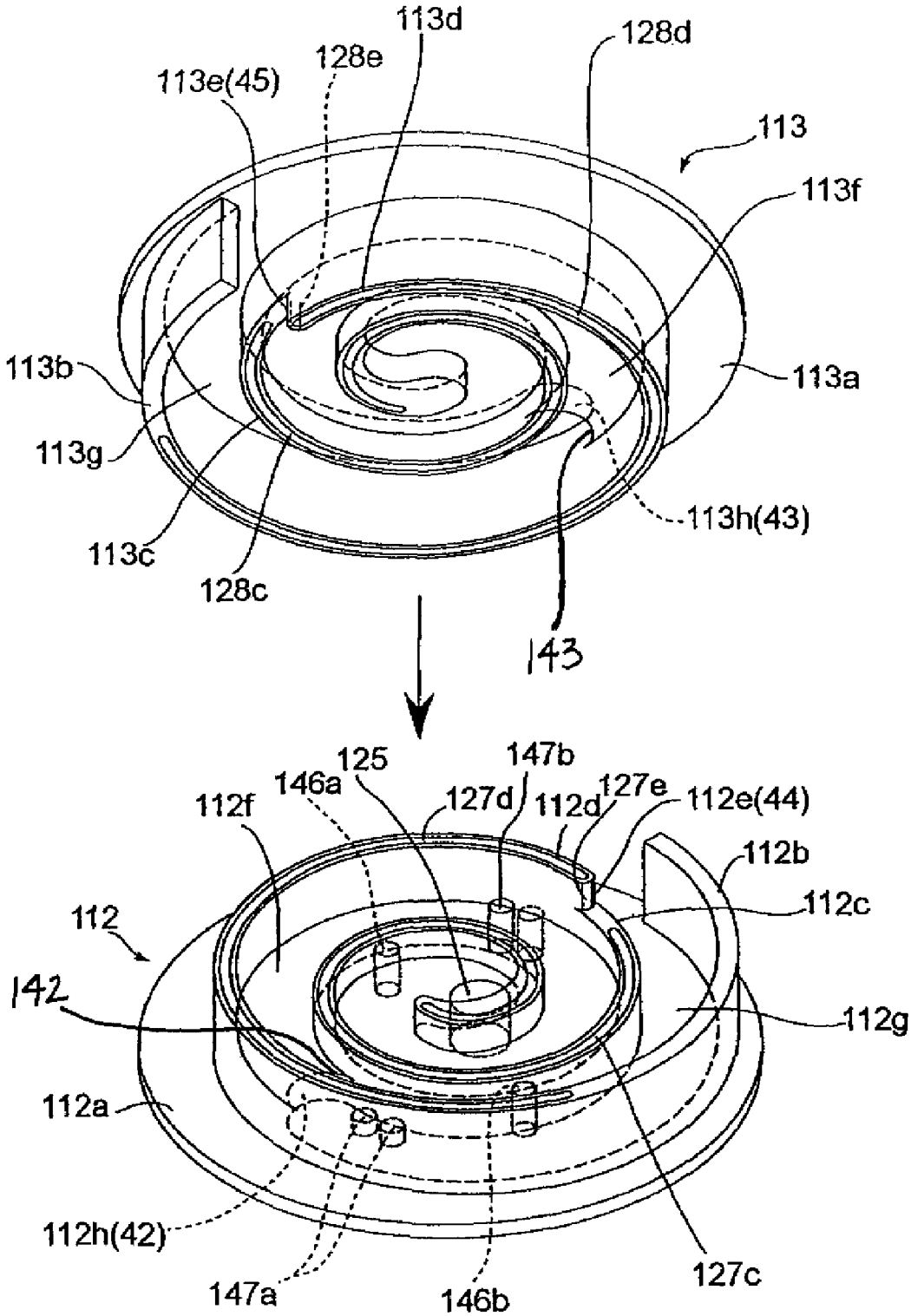
FIG. 12 is a perspective view showing a fixed scroll and a revolving scroll in the second embodiment.

As shown in FIG. 12, the end plate 112*a* of the fixed scroll 112 includes a step portion 142. At this step portion 142, the surface of the end plate 112*a* that is toward the center of the spiral, which is formed by the wall 112*b*, is elevated than the surface of the end plate 112*a* that is toward the outer end of the spiral. Similarly, the end plate 113*a* of the revolving scroll 113 includes a step portion 143. At this step portion 143, the surface of the end plate 113*a* that is toward the center of the spiral, which is formed by the wall 113*b*, is elevated than the surface of the end plate 13*a* that is toward the outer end of the spiral. The step portions 142 and 143 are provided at positions that are substantially equidistance from the centers of the respective spirals.

Since the step portion 142 is formed on the surface of the end plate 112*a*, the flow path formed in the wall 112*b* can be divided into two portions, that is, a flow path having a shallower bottom surface 112*f*, which is closer to the center of the spiral, and a flow path having a deep bottom surface 112*g*, which is closer to the outer end of the spiral. A coupling wall surface 112*h*, which is formed in the step portion 142 and stands vertically to the adjacent bottom surfaces 112*f* and 112*g*, is present between the bottom surfaces 112*f* and 112*g*. Similarly, since the step portion 143 is formed on the surface of the end plate 113*a*, a spiral flow path formed in the wall 113*b* is divided into two portions, that is, a shallow bottom surface 113*f* provided closer to the center and a deep bottom surface 113*g* provided closer to the outer end. A coupling wall surface 113*h*, which forms the step portion 143 and stands vertically connecting the adjacent bottom surfaces 13*f* ad 113*g*, is present between the bottom surfaces 113*f* and 113*g*.

In addition, the wall 112*b* of the fixed scroll 112 includes a stepped portion 144 that corresponds to the step portion 143 of the revolving scroll 113. The wall 112*b* includes two portions of which edge is arranged at each different level. The edge of the portion that is closer to the center of the spiral is at a lower level than the edge of the portion that is closer to f the outer end of the spiral relative to the level of the surface of the end plate 112*a*. Similarly, the wall 113*b* on the revolving scroll 113 includes a stepped portion 145 that corresponds to the step portion 142 of the fixed scroll 112. The wall 13*b* includes two portions of which edge is arranged at each different level. The edge of the portion that is closer to the center of the spiral is at a lower level than the edge of the portion that is closer to the outer end of the spiral relative to the level of the surface of the end plate 113*a*.

Since the stepped portion 144 is formed, the edge of the wall 112*b* is divided into two portions, that is, a low edge 112*c* provided closer to the center and a high edge 112*d* provided closer to the outer end. A coupling edge 112*e*, which forms the stepped portion 144 and connects the edges 112*c* and 112*d* to be vertical to a revolving surface, is present between the adjacent edges 112*c* and 112*d*. Similarly, since the stepped portion 145 is formed, the edge of the wall 113*b* is divided into two portions, that is, a low edge 113*c* provided closer to the center and a high edge 113*d* provided closer to the outer end. A coupling edge 113*e*, which forms the stepped portion 145 and connects the edges 113*c* and 113*d* to be vertical to the revolving surface, is present between the adjacent edges 113*c* and 113*d*.

The coupling edge 112*e* is formed in such a manner that a surface of the coupling edge 112*e* that is vertical to the end plate 12*a* continues smoothly curving between the wall 112*b*. A curved line formed with the surface is semicircle when viewed from a direction perpendicular to the end plate 112*a*. Similarly, the coupling edge 113*e* is formed in such a manner that a surface of the coupling edge 113*e* that is vertical to the end plate 113*a* continues smoothly curving between the wall 113*b*. A curved line formed with the surface is semicircle when viewed from a direction perpendicular to the end plate 113*a*. In addition, the coupling wall surface 112*h* forms an arc that is identical with an envelope drawn by the coupling edge 113*e* in accordance with revolution of the revolving scroll 113 when the end plate 112*a* is viewed from a revolving shaft direction. Similarly, the coupling wall surface 113*h* forms an arc that is identical with an envelope drawn by the coupling edge 112*e* in accordance with revolution of the revolving scroll 113.

Figure 13:
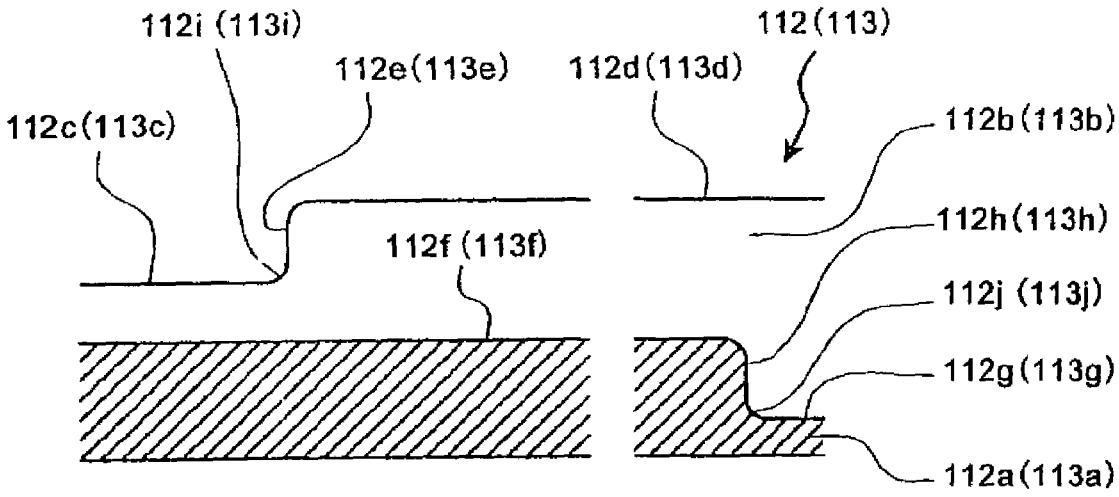
FIG. 13 is a sectional view of the fixed scroll (or the revolving scroll) in the second embodiment.

As shown in FIG. 13, a rib 112*i* is provided in a part where the edge 112*c* and the coupling edge 112*e* meet in the wall 112*b* as if the rib 112*i* is built up. The rib 112*i* is formed integrally with the wall 112*b* forming a recessed curved surface that continues smoothly to the edge 112*d* and the coupling edge 112*e* to avoid concentration of stresses. For the same reason, a rib 113*i* that has a same shape as the rib 112*i* is provided in a part where the edge 113*c* and the coupling edge 113*e* meet in the wall 113*b*.

A rib 112*j* is provided in a part where the bottom surface 112*g* and the coupling wall surface 112*h* meet in the end plate 112*a* as if the rib 112*j* is built up. The rib 112*j* is formed integrally with the wall 112*b* forming a recessed curved surface that continues smoothly to the bottom surface 112*g* and the coupling wall surface 112*h* to avoid concentration of stresses. Due to the same reason, a rib 113*j* of the same shape is provided in a part where the bottom surface 113*g* and the coupling wall surface 113*h* meet in the end plate 113*a*.

A part where the edges 112*d* and 112*e* meet in the wall 112*b* is chamfered to avoid interference with the rib 113*j* at the time of assembling. A part where the edges 113*d* and 113*e* meet in the wall 113*b* is chamfered to avoid interference with the rib 112*j* at the time of assembling.

As shown in FIG. 12, chip seals 127*c*, 127*d*, and 127*e* are disposed in the edges 112*c* and 112*d* and the coupling edge 112*e* of the wall 112*b*, respectively. Similarly, chip seals 128*c*, 128*d*, and 128*e* are disposed in the edges 113*c* and 113*d* and the coupling edge 113*e* of the wall 113, respectively.

Figure 14:
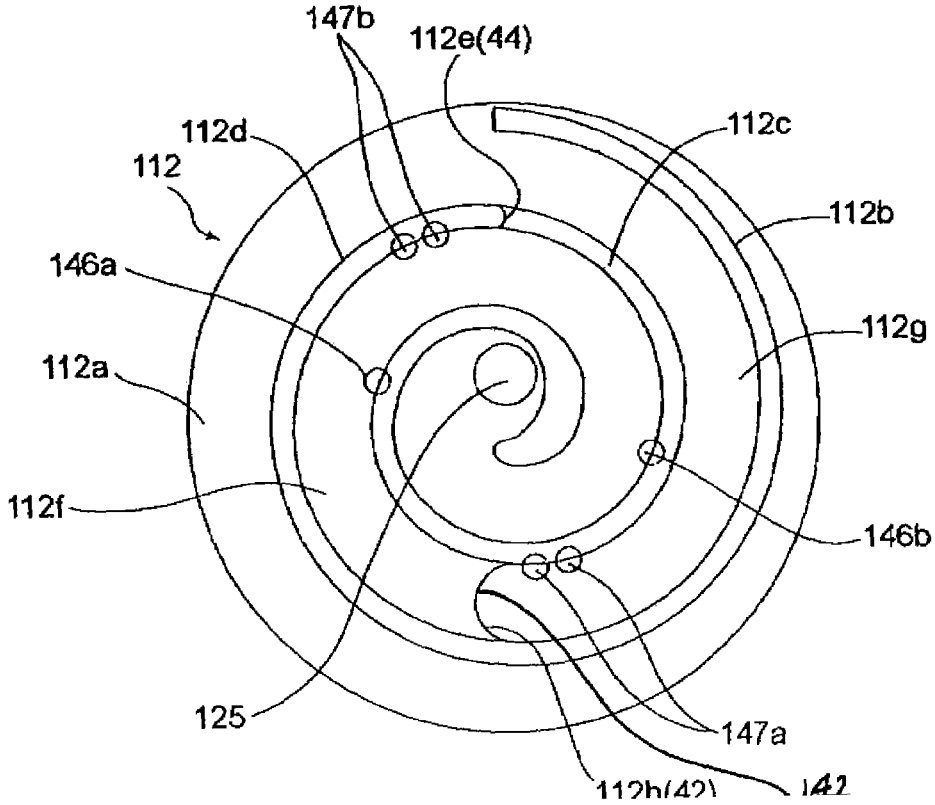
FIG. 14 is a plan view of the fixed scroll in the second embodiment.

On the other hand, as shown in FIGS. 12 and 14, first bypass holes 146*a* and 146*b* that pair off with each other are provided on a bottom surface 112*f*. The bottom surface 112*f* is a surface of a portion in the end plate 112*a* of the fixed scroll 112 that is positioned closer to the center of the spiral than the position of the step portion 142. In addition, the first bypass holes 146*a* and 146*b* are provided in positions within 360 degrees ($2\pi$(rad)) to the center from positions of second bypass holes 147*a* and 147*b*, which will be described later, in a state in which the revolving scroll 113 is combined with the fixed scroll 112. The first bypass hole 146*a* is arranged on the bottom surface 112*f* at a position near the outer end of the spiral, and is arranged along the surface of the wall

112*b* that faces opposite to the center of the spiral. The first bypass hole 146*b* is in a symmetrical position with respect to the first bypass hole 146*a* and is arranged on the bottom surface 112*f* in a position near the center of the spiral, and is arranged along the surface of the wall 112*b* that faces toward the center of the spiral.

In a state in which the revolving scroll 113 is combined with the fixed scroll 112, openings of the first bypass holes 146*a* and 146*b* facing the end plate 112*a* are made openable and closable by the low edge 113*c* of the wall 113*b* of the revolving scroll 113. In addition, the first bypass holes 146*a* and 146*b* are pierced through the end plate 112*a* and open at the surface opposite to the surface on which the wall 112*b* is arranged. Although not clearly shown in the figures, opening of the first bypass holes 146*a* and 146*b* communicate with the intake chamber 122. For example, a part of the housing body 11*a*, where the opening of the first bypass holes 146*a* and 146*b* are located, is divided from the discharge cavity 124 by a partition wall or the like and communicates with the intake chamber 122. In addition, although not clearly shown in the figures, valves are provided in the opening of the first bypass holes 146*a* and 146*b*. The valves open and close the opening as required.

Second bypass holes 147*a* and 147*b* that pair off with each other are provided on the bottom surfaces 112*g*. The bottom surface 112*g* is a surface of a portion in the end plate 112*a* of the fixed scroll 112 that is positioned closer to the outer end of the spiral than the positions of the first bypass holes 146*a* and 146*b*. The second bypass holes 147*a* and 147*b* are provided in positions within 360 degrees (2π(rad)) to the center from the outer end of the spiral in a state in which the revolving scroll 113 is combined with the fixed scroll 112. The second bypass hole 147*a* is arranged on the bottom surface 112*g* at a position near the outer end of the spiral, and is arranged along the surface of the wall 112*b* that faces opposite to the center of the spiral. The second bypass hole 147*b* is in a symmetrical position with respect to the second bypass hole 147*a* and is arranged on the bottom surface 112*f* in a position near the center of the spiral, and is along the surface of the wall 112*b* that faces toward the center of the spiral. Note that the second bypass holes 147*a* and 147*b* in this embodiment are provided in parallel in two places, respectively.

In a state in which the revolving scroll 113 is combined with the fixed scroll 112, an opening of the second bypass hole 147*a* facing the end plate 112*a* is made openable and closable by the high edge 113*d* of the wall 113*b* of the revolving scroll 113. In addition, in a state in which the revolving scroll 113 is combined with the fixed scroll 112, an opening of the second bypass hole 147*b* that faces to the surface on which the wall 112*b* is arranged made openable and closable by the low edge 113*c* of the wall 113*b* of the revolving scroll 113. The second bypass holes 147*a* and 147*b* are pierced through the end plate 112*a* and open at the surface opposite to the surface on which the wall 112*b* is arranged. Although not clearly shown in the figures, opening of the second bypass holes 147*a* and 147*b* communicate with the intake chamber 122. For example, a part of the housing body 111*a*, where the opening of the second bypass holes 147*a* and 147*b* are located, is divided from the discharge cavity 124 by a partition wall or the like and communicates with the intake chamber 122. In addition, although not clearly shown in the figures, valves are provided in the opening of the second bypass holes 147*a* and 147*b*. The valves open and close the opening of the second bypass holes 147*a* and 147*b* as required.

Figure 15:
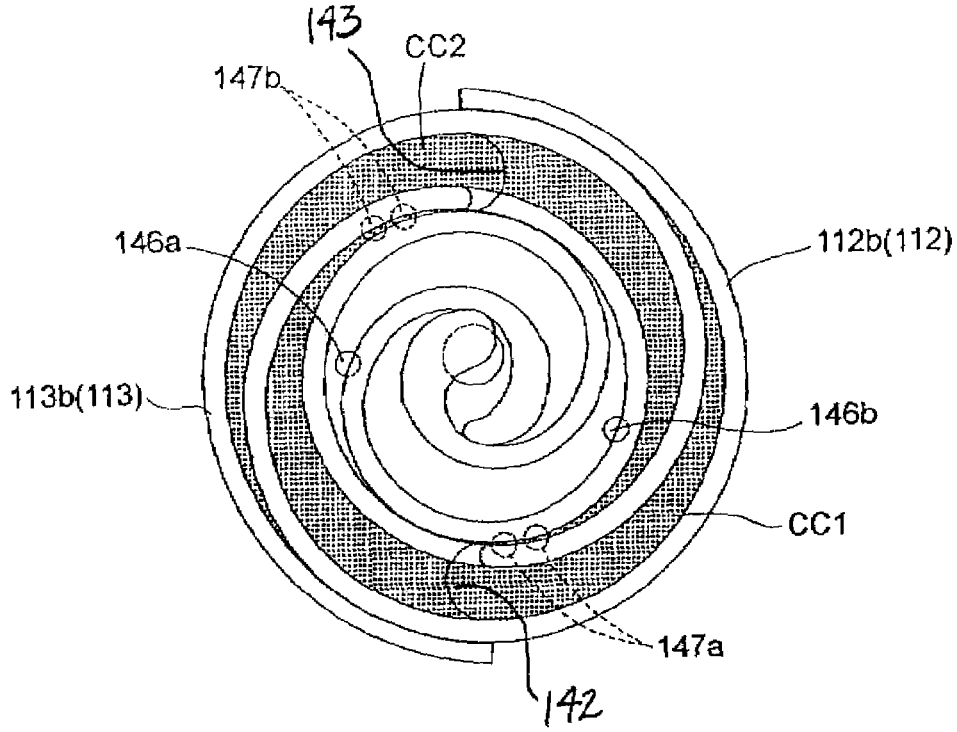
FIGS. 15 to 20 are schematics for explaining an operation of the scroll compressor of the second embodiment.

As shown in FIG. 15, when the revolving scroll 113 is combined with the fixed scroll 112, the low edge 113*d* comes into abutment against the shallow bottom surface 112*f*, and the high edge 13*c* comes into abutment against the deep bottom surface 112*g*. At the same time, the low edge 112*d* comes into abutment against the shallow bottom surface 113*f*, and the high edge 112*c* comes into abutment against the deep bottom surface 113*g*. Consequently, a pair of compression chambers CC1 and CC2, which are sectioned by the end plates 112*a* and 113*a* and the walls 112*b* and 113*b* opposed to each other, respectively, are formed between both the scrolls. In these compression chambers CC1 and CC2, since the deep bottom surfaces 112*g* and 113*g* face each other on the side closer to the outer end of the spiral than the step portions 142 and 143, the wide compression chambers CC1 and CC2 are obtained further on the outer end side of the spiral than the step portions 142 and 143. Since the shallow bottom surfaces 112*g* and 113*g* face each other on the side closer to the center of the spiral than the step portions 142 and 143, the narrow compression chambers CC1 and CC2 are obtained on side closer to the center of the spiral than the step portions 142 and 143. As a result, compression with a volume gradually reduced from the compression chambers CC1 and CC2 formed wide to the compression chambers CC1 and CC2 formed narrow is performed in the middle of movement of the compression chambers CC1 and CC2 from the outer end to the center in accordance with revolution of the revolving scroll 113. Thus, a compression ratio can be improved.

In the middle of movement of the compression chambers CC1 and CC2 from the outer end to the center in accordance with the revolution of the revolving scroll 113, when the edge 113*c* of the wall 113*b* comes off the opening of each of the bypass holes 46*a* and 46*b* facing toward the end plate 113*a*, and the valve in the opening is opened, the first bypass holes 146*a* and 146*b* and the second bypass holes 147*a* and 147*b* cause the compression chambers CC1 and CC2 and the intake chamber 122 to communicate with each other. In addition, the first bypass holes 146*a* and 146*b* separate the compression chambers CC1 and CC2 and the intake chamber 122 when the valves are closed. As a result, if the valves are opened as required, since compression is not performed in the compression chambers CC1 and CC2 of which compression is released through the opening of the first bypass holes 146*a* and 146*b*. The second bypass holes 147*a* and 147*b* are open, it becomes possible to reduce a compression volume to reduce load on the drive source driving the rotation shaft 116. In this way, the first bypass holes 146*a* and 146*b* and the second bypass holes 147*a* and 147*b* perform volume control for the compression chambers CC1 and CC2.

How the scroll compressor the compresses fluid will be explained with reference to FIGS. 15 to 20. Note that, in the following explanation, the valves are performing an opening operation in the opening the first bypass holes 146*a* and 146*b* and the second bypass holes 147*a* and 147*b*.

In the state shown in FIG. 15, an outermost end of the wall 112*b* comes into abutment against the surface of the wall 113*b* 13*b* that faces opposite to the center of the spiral, and an outermost end of the wall 113*b* comes into abutment against the surface of the wall 112*b* that face opposite to the center of the spiral. Fluid is encapsulated between the end plates 112*a* and 113*a* and between the walls 112*b* and 113*b*. The compression chambers CC1 and CC2 with a maximum volume are formed in positions opposed to each other across the center of the scroll compression mechanism. At this point, the second bypass holes 147*a* and 147*b* communicate with the compression chambers CC1 and CC2, and the first bypass holes 146*a* and 146*b* do not communicate with the compression chambers CC1 and CC2.

Figure 16:
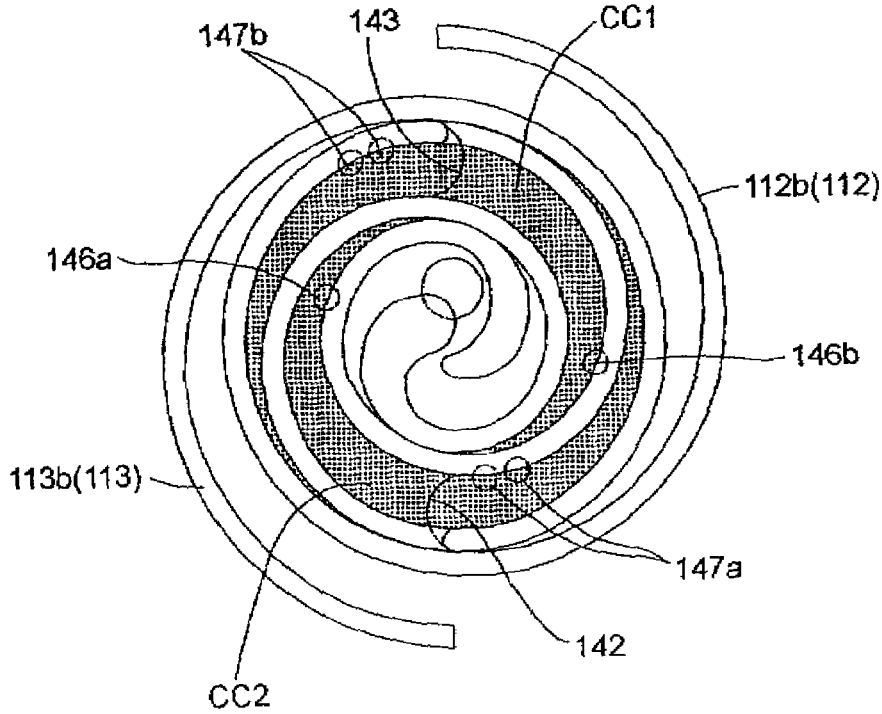

In a step in which the revolving scroll 113 revolves π(rad) from the state of FIG. 15 to reach a state shown in FIG. 16, the compression chambers CC1 and CC2 move to the center. In the state shown in FIG. 16, the first bypass holes 146*a* and 146*b* and the second bypass holes 147*a* and 147*b* communicate with the compression chambers CC1 and CC2. Consequently, although a volume of the compression chambers CC1 and CC2 are gradually reduced, compression is not performed.

Figure 17:
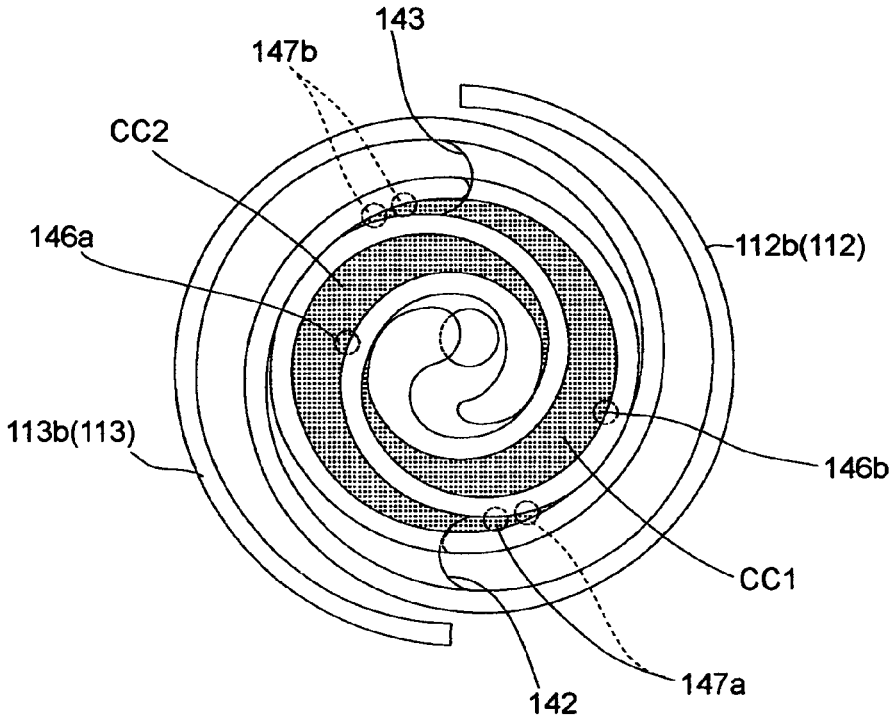

In a step in which the revolving scroll 113 revolves π/2(rad) from the state of FIG. 16 to reach a state shown in FIG. 17, the compression chambers CC1 and CC2 moves to the center. In the state shown in FIG. 17, the first bypass holes 146*a* and 146*b* and the second bypass holes 147*a* and 147*b* communicate with the compression chambers CC1 and CC2. Consequently, although a volume of the compression chamber CC1 and CC2 are gradually reduced, compression is not performed. In addition, in the state shown in FIG. 17, the outer end of the wall 112*b* is spaced apart from the surface of the wall 113*b* that faces opposite to the center of the spiral, and a portion in the outer end of the wall 113*b* is spaced apart from the surface of the wall 112*b* that faces opposite to the center of the spiral. In this case, leakage of fluid from the step portions 142 and 143 is assumed. However, since the first bypass holes 146*a* and 146*b* and the second bypass holes 147*a* and 147*b* communicate with the compression chambers CC1 and CC2 as described above, compression is not performed in the compression chambers CC1 and CC2. Thus, there is no influence of the leakage of fluid.

Figure 18:
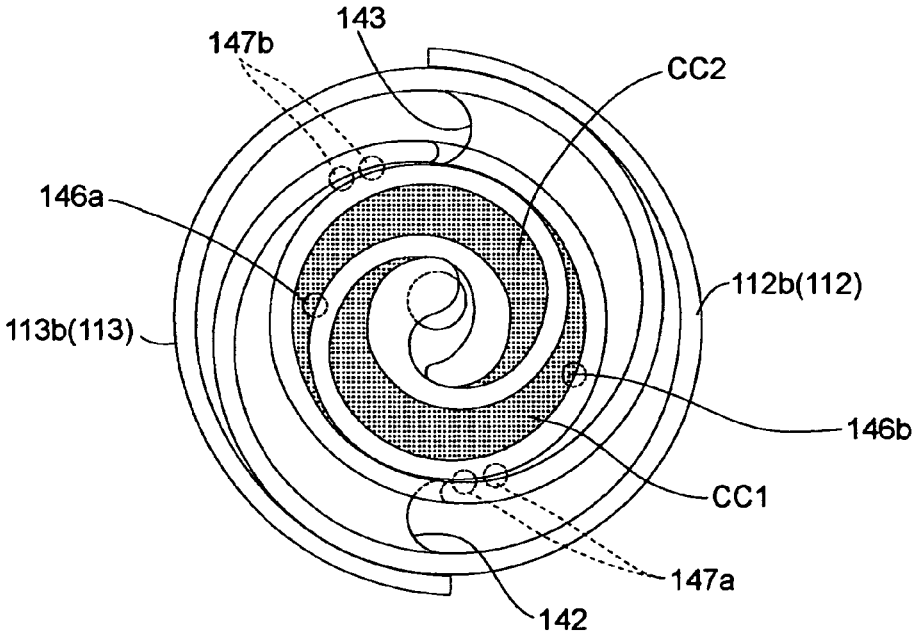

In a step in which the revolving scroll 113 revolves π/2(rad) from the state of FIG. 17 to reach a state shown in FIG. 18, the compression chambers CC1 and CC2 moves to the center. In this step, since the bypass holes 146*a* and 146*b* communicate with the compression chambers CC1 and CC2, although a volume of the compression chambers CC1 and CC2 are gradually reduced, compression is not performed. In the state shown in FIG. 18, the opening parts of the second bypass holes 147*a* and 147*b* are blocked by the edge 113*c* of the wall 113*b*.

Figure 19:
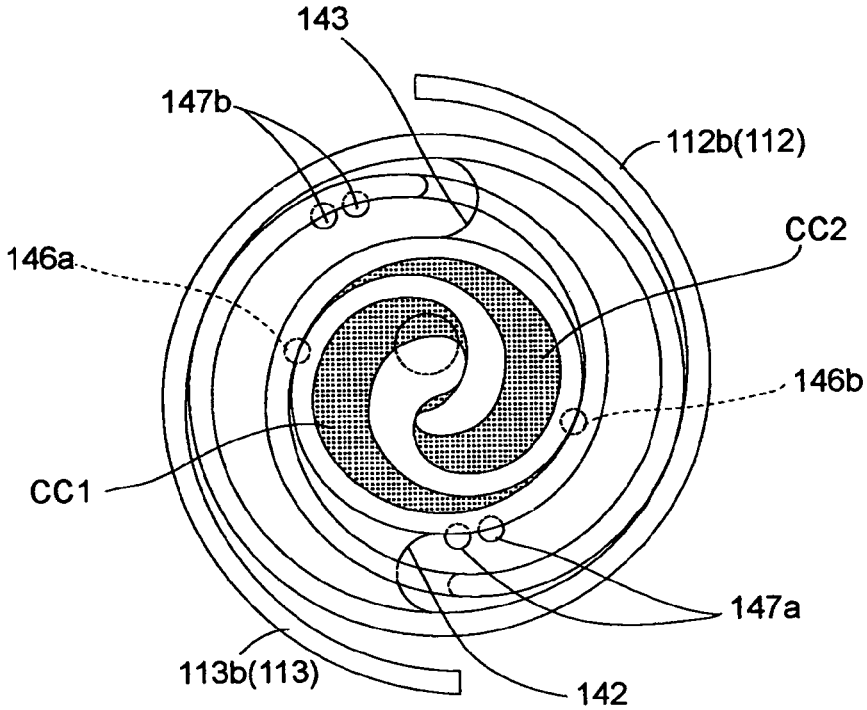

In a step in which the revolving scroll 113 revolves π/2(rad) from the state of FIG. 18 to reach a state shown in FIG. 19, the compression chambers CC1 and CC2 move to the center. In the state shown in FIG. 19, the opening parts of the first bypass holes 146*a* and 146*b* are blocked by the edge 113*c* of the wall 113*b*. Consequently, the compression chambers CC1 and CC2 are brought into a closed state.

Figure 20:
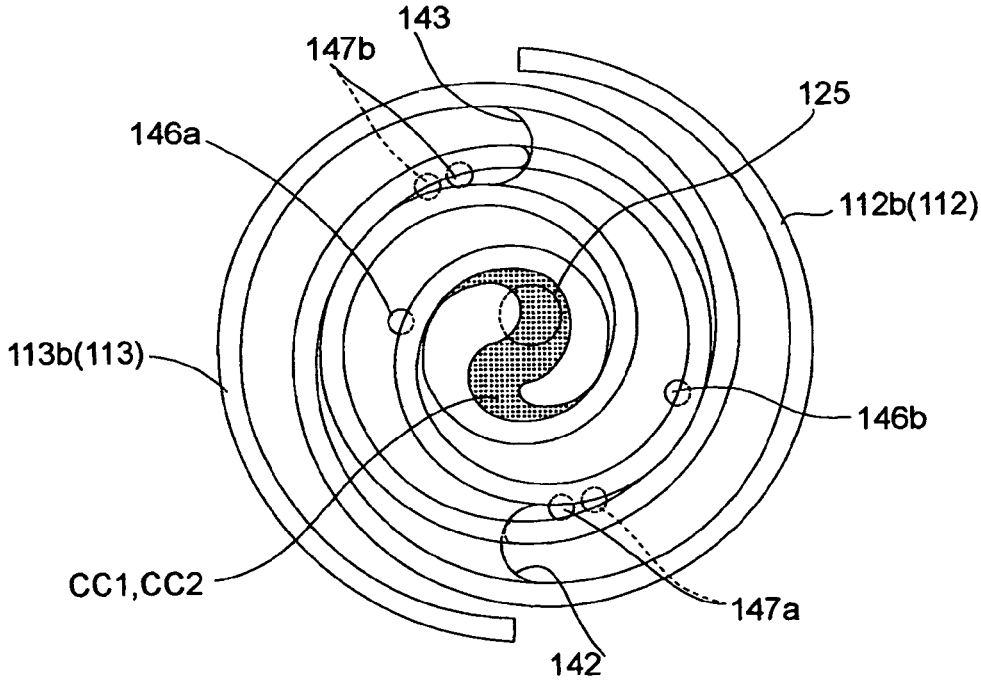

In a step in which the revolving scroll 113 revolves π(rad) from the state of FIG. 19 to reach a state shown in FIG. 20, the compression chambers CC1 and CC2 move to the center while keeping the closed state and a volume of the compression chambers CC1 and CC2 are gradually reduced to compress fluid. Thereafter, by continuing the compression, the compression chambers CC1 and CC2 merge to have a minimum volume, and the fluid is discharged from the scroll compressor via the discharge port 125. Note that, in steps after FIG. 18, since the compression chambers CC1 and CC2 are in positions not involved in the step portions 142 and 143, the fluid in the compression chambers CC1 and CC2 never leak from the step portions 142 and 143.

Therefore, the scroll compressor according to the second embodiment includes the structure in which the step portions 142 and 143 and the first bypass holes 146*a* and 146*b* are provided, and the first bypass holes 146*a* and 146*b* are provided in the positions that is closer to the center of the spiral than the positions of the step portions 142 and 143. Consequently, when leakage of the fluid is assumed from a contact part of the step portions 142 and 143 and the stepped portions 144 and 145, since the bypass holes 146*a* and 146*b* communicate with the compression chambers CC1 and CC2 and compression is not performed, there is no influence of the leakage of the fluid. In addition, when the opening of the first bypass holes 146*a* and 146*b* are blocked to bring the compression chambers CC1 and CC2 into a closed state, since the compression chambers CC1 and CC2 are in positions not involved in the step portions 142 and 143, the fluid in the compression chambers CC1 and CC2 never leaks from the step portions 142 and 143, and compression can be performed.

Figure 21:
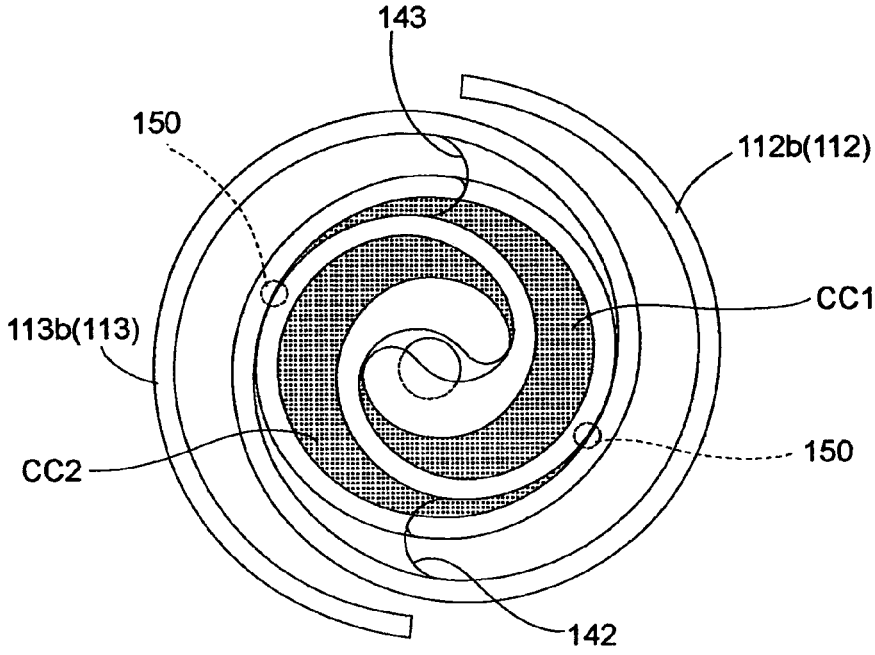
FIG. 21 is a plan view of a conventional scroll compressor corresponding to the scroll compressor of the second embodiment.

When bypass holes 150, which are equivalent to the first bypass holes 146*a* and 146*b*, are provided further on the outer end side of the spiral than the step portions 142 and 143 as shown in FIG. 21, even if opening of the bypass holes 50 are blocked and in a state of compression, a state occurs in which the step portions 142 and 143 are placed astride the compression chambers CC1 and CC2 that should perform compression. As a result, a compression loss occurs because there is compression leakage in the step portions 142 and 143 despite the fact that a compression volume of the bypass holes 150 is reduced. On the other hand, the scroll compressor in the first embodiment can obtain the advantages of the step portions 142 and 143 and the first bypass holes 146*a* and 146*b* without causing the compression loss.

Figure 22:
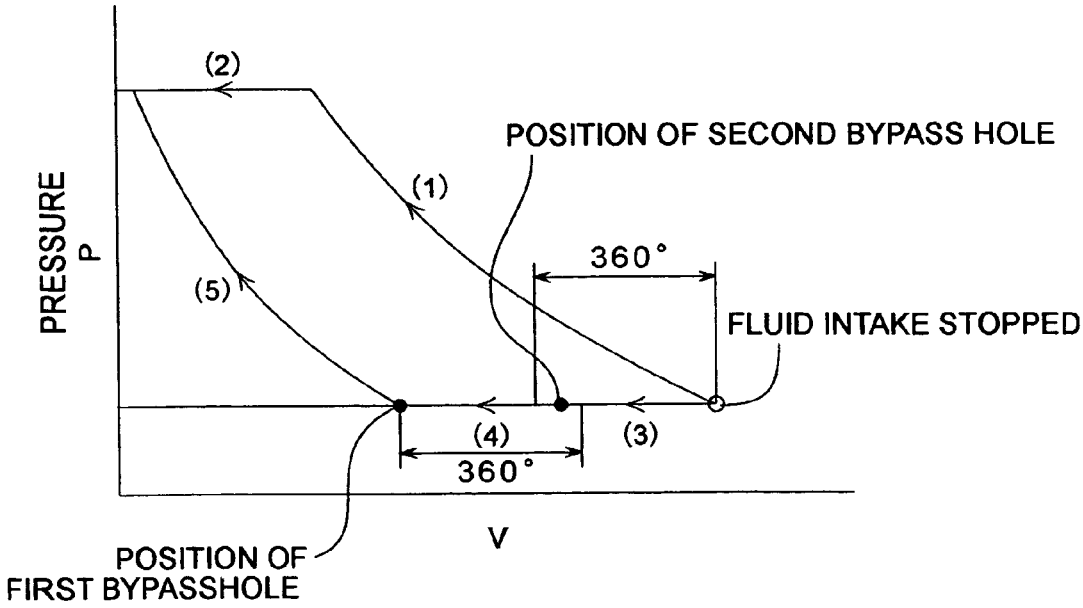
FIG. 22 is a PV graph of the scroll compressor in the second embodiment.

In the scroll compressor in the second embodiment, the second bypass holes 147*a* and 147*b* are provided in positions closer to the outer end of the spiral than the positions of the first bypass holes 146*a* and 146*b* and within 360 degrees (2π(rad)) to the center from the outer end of the spiral. In addition, the first bypass holes 146*a* and 146*b* are provided in positions within 360 degrees (2π(rad)) to the center from the positions of the second bypass holes 147*a* and 147*b*. Consequently, as shown in FIG. 22, volume control is applied to the compression chambers CC1 and CC2, which move according to revolution of the revolving scroll 113, with only the second bypass holes 147*a* and 147*b* present in the compression chambers CC1 and CC2 formed on the outermost end by closing up intake of the fluid (3). Volume control is applied to the compression chambers CC1 and CC2, which have moved to the center of the spiral from there, with both the first bypass holes 146*a* and 146*b* and the second bypass holes 147*a* and 147*b* present (3) (4). Then, the volume control is applied to the compression chambers CC1 and CC2, which have moved further to the center side of the spiral, with only the first bypass holes 146*a* and 146*b* present (4). This makes it possible to prevent excessive compression after the compression chambers CC1 and CC2 are formed on the side near the outermost end of the spiral before volume control is performed by the first bypass holes 146*a* and 146*b*. Note that, in FIG. 22, (1)→(2) indicates a case in which the valves of the first bypass holes 146*a* and 146*b* and the second bypass holes 147*a* and 147*b* are closed, and the volume control is not performed.

Figure 23:
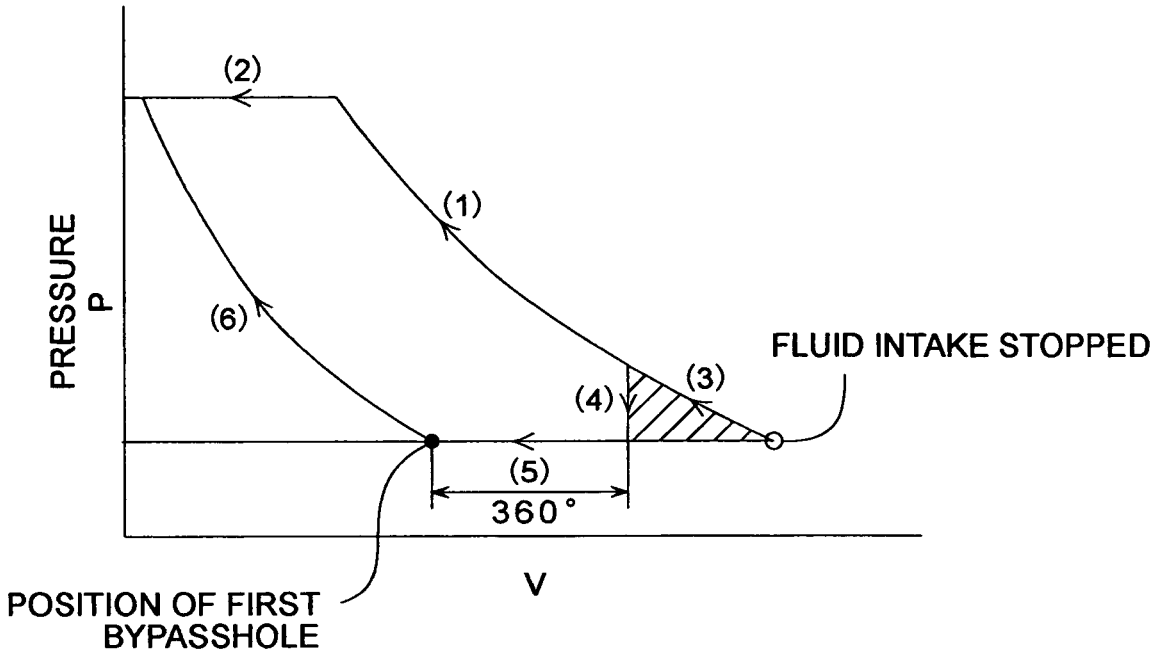
FIG. 23 is a PV graph of the conventional scroll compressor shown in FIG. 21.

As shown in FIG. 23, when the second bypass holes 147*a* and 147*b* are not provided as shown in FIG. 23, after the excessive compression occurs (3)→(4), the volume control is performed by the first bypass holes 146*a* and 146*b* (5). In this way, the compression of the compression chambers CC1 and CC2 occurs 360 degrees or more before performing the volume control with the first bypass holes 146*a* and 146*b*. On the other hand, the scroll compressor in the second embodiment can obtain advantages of the step portions 142 and 143 and the first bypass holes 146*a* and 146*b* without causing the excess compression. Note that, in FIG. 23, (3)>(1) indicates a case in which the valves of the first bypass holes 146*a* and 146*b* are closed, and the volume control is not performed.

As described above, the scroll compressor according to the present invention makes it possible to reduce a compression loss. In particular, the scroll compressor is suitable for eliminating compression leakage in the step portions when volume control is performed by the bypass holes. In addition, in particular, the scroll compressor is suitable for preventing excessive compression.

Moreover, the bypass holes are provided in positions closer to the center of the spiral than positions of the step portions. Consequently, when leakage of fluid from the step portions is assumed, since compression is not performed through the bypass holes, there is no influence of the leakage of fluid. In addition, when the bypass holes are closed to bring the compression chambers into a closed state, since the compression chambers are in a positional relation in which the compression chambers are not involved in the step portions, compression in the compression chambers is performed without regard to the leakage of fluid from the step portions. As a result, advantages of the step portions and the bypass holes can be obtained without causing a compression loss due to the leakage of fluid from the step portions.

Moreover, the second bypass holes are provided in positions closer to the outer end of the spiral than positions of the first bypass holes and within 360 degrees to the center from the outer end of the spiral, and the first bypass holes are provided in positions closer to the center of the spiral than positions of the step portions and within 360 degrees to the center from the positions of the second bypass holes. Consequently, the second bypass holes can prevent excessive compression after the compression chambers are formed on a side near the outermost end of the spiral and before volume control is performed by the first bypass holes. In addition, since the first bypass holes are provided in the positions closer to the center of the spiral than the positions of the step portions, advantages of the step portions and the first bypass holes can be obtained without causing a compression loss due to leakage of fluid from the step portions.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A scroll compressor comprising:

a first scroll that has a first end plate and a first spiral wall disposed on a surface of the first end plate; and a second scroll that has a second end plate and a second spiral wall on a surface of the second end plate, the second scroll being supported so as to be revolvable while being prevented from rotating, and the second spiral wall being engaged with the first spiral wall, wherein at least one of the first end plate and the second end plate includes a step portion where a height of the surface of at least one of the first end plate and the second end plate is set high on a center side and is set low on an outer end side of a spiral along at least one of the first spiral wall and the second spiral wall, at least one of the second spiral wall and the first spiral wall includes a stepped portion where a height of at least one of the second spiral wall and the first spiral wall is set low on the center side and is set high on the outer end side, so that the stepped portion engages the step portion so that a bottom surface of at least one of the first and the second scroll and an edge of at least one of the second spiral wall and the first spiral wall are in contact with each other to form a compression chamber surrounded by the first spiral wall, the second spiral wall, the first end plate and the second end plate, an intake chamber is formed in a position around the first scroll, the first end plate includes a first bypass hole that is provided in a position between the step portion and a center of the spiral, the first bypass hole communicates the compression chamber with the intake chamber, and the first end plate includes a second bypass hole that is provided in a position between the first bypass hole and an outer end of the spiral, the second bypass hole communicates the compression chamber with the intake chamber.

2. The scroll compressor according to claim 1, wherein the second bypass hole is provided at a position within 360 degrees from the outer end of the spiral to the center of the spiral, and the first bypass hole is provided at a position within 360 degrees from the second bypass hole to the center of the spiral.

* * * * *